US005685101A

United States Patent [19]

Ferretti

[11] Patent Number: 5,685,101

[45] Date of Patent: Nov. 11, 1997

[54] FIREARM FITTED WITH A PIVOTING MAGAZINE

[76] Inventor: Maurice Ferretti, 23 rue du Stade, 13015 Marseille, France

[21] Appl. No.: 532,775

[22] PCT Filed: Jul. 15, 1994

[86] PCT No.: PCT/FR94/00889

§ 371 Date: Feb. 28, 1996

§ 102(e) Date: Feb. 28, 1996

[87] PCT Pub. No.: WO95/02799

PCT Pub. Date: Jan. 26, 1995

[30] Foreign Application Priority Data

Jul. 16, 1993 [FR] France ..... 93 09070

[51] Int. Cl.[6] ..... F41A 3/00

[52] U.S. Cl. ..... 42/18; 42/22; 42/50; 89/34

[58] Field of Search ..... 42/50, 18, 22; 89/34

[56] References Cited

U.S. PATENT DOCUMENTS

| | | | |
|---|---|---|---|
| 551,572 | 12/1895 | Bennett | 42/18 |
| 667,856 | 2/1901 | Wagner | 42/18 |
| 3,390,476 | 7/1968 | Vervier | 42/18 |
| 4,450,641 | 5/1984 | Bullis et al. | 42/6 |

FOREIGN PATENT DOCUMENTS

| | | |
|---|---|---|
| 670534 | 10/1965 | Belgium . |
| 120862 | 5/1901 | Germany . |
| 130805 | 5/1902 | Germany . |

*Primary Examiner*—J. Woodrow Eldred
*Attorney, Agent, or Firm*—Ladas & Parry

[57] ABSTRACT

The present invention relates to an improvement to individual firearms; the technical field of the invention is that of manufacturing firearms. A firearm includes a pin extending crosswise into the magazine well, mounted at at least one of its two ends in a respective recess provided in the left or right side walls of the magazine well; said pin extends inside said magazine case, passes through at least one of the left or right side walls of said magazine in which an orifice is provided; said pin is situated in the immediate vicinity of a bottom abutment limiting the stroke of said cartridge lift, i.e. it is situated at a short distance from said abutment, as measured along the longitudinal axis ZZ in which the cartridges are stacked.

24 Claims, 4 Drawing Sheets

FIG.1
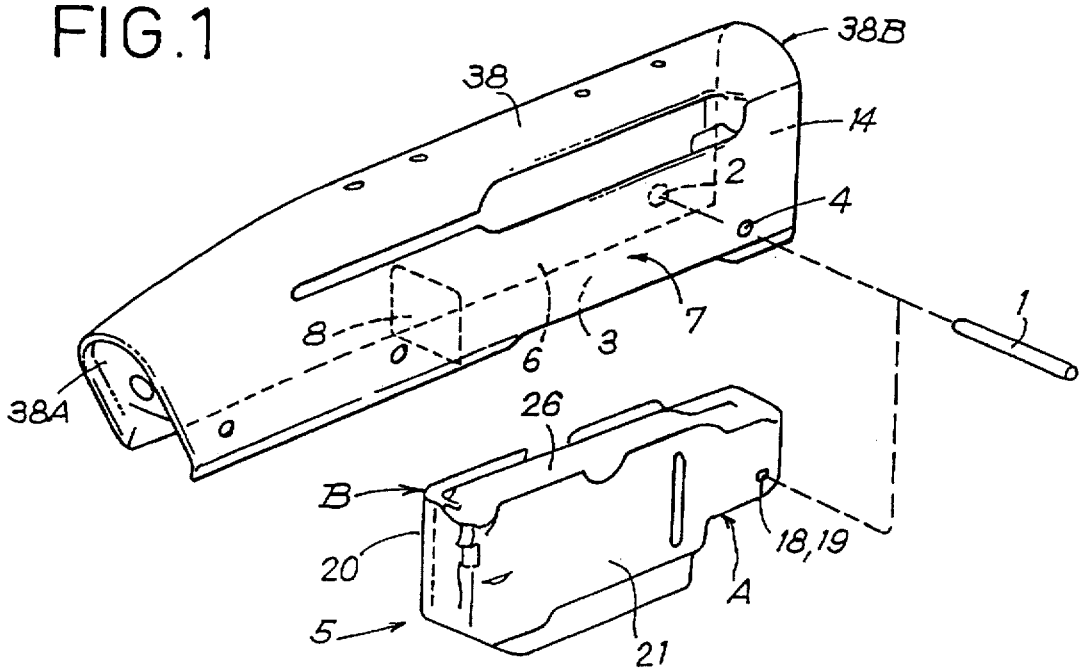
FIG.2
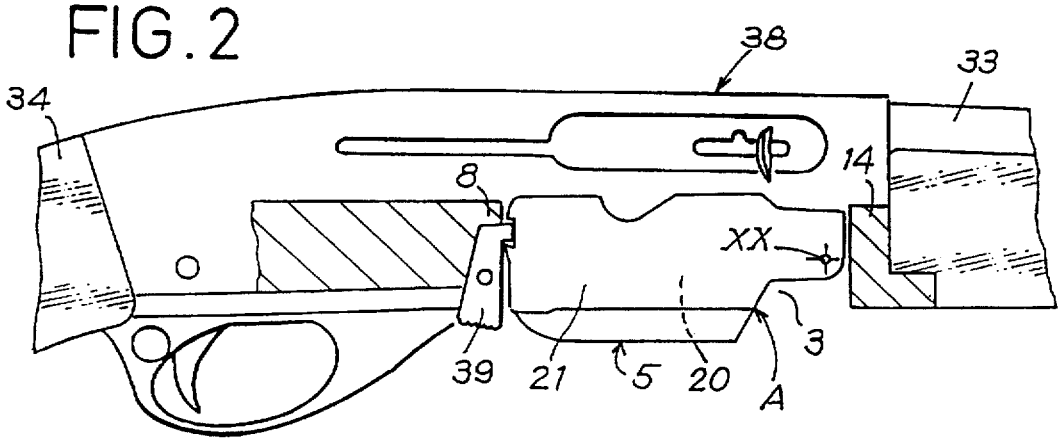
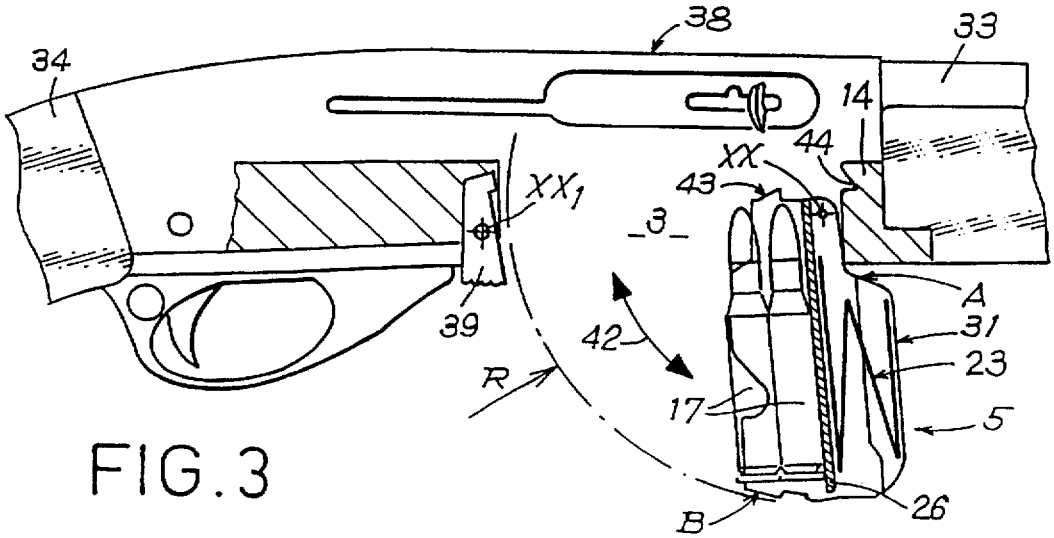
FIG.3

FIREARM FITTED WITH A PIVOTING MAGAZINE

FIELD OF THE INVENTION

The present invention relates to an improvement applied to individual firearms of the kind having a pivoting magazine, and it provides a device that makes it possible to ensure that the pivoting magazines of semi-automatic hunting rifles, in particular, incapable of being removed from the firearm.

The technical field of the invention is that of manufacturing firearms.

BACKGROUND OF THE INVENTION

Traditionally, most long-barrelled firearms (for shooting from the shoulder) that operate semi-automatically, whether by central percussion or by annular percussion, posses a cartridge magazine also called a magazine case or a charger that is substantially in the form of a parallelepiped, and that engages in a housing in the firearm as is normally situated beneath the breech and is referred to as the magazine well.

The inside dimensions of the magazine well are very close to the dimensions of the magazine case, to ensure that there is little play between the magazine and its housing. This means that the magazine can be inserted or extracted solely by a movement in linear translation through the open bottom of the magazine well.

This type of magazine is generally held in place by a latch carried by the magazine well (or by the breech casing) co-operating with a notch or a recess or a projection on the magazine so as to lock it in the firearm operating position.

With some firearms, the magazine carries the latch and the firearm carries the fastener element that co-operate with the latch.

This type of magazine case is usually constituted by a sheet steel box in which there slides in the vertical direction (down and up) a part whose shape is substantially complementary to the shape (inside section) of the magazine, and which is urged towards the open end of the magazine by a spring, i.e. towards the top of the magazine.

This part, referred to as a lift or lift plate or platform, serves to support the stack of cartridges and to urge the cartridges towards the top of the magazine each time one of them is inserted into the firing chamber.

The number of cartridges that such a magazine case can contain is a function of the distance that the lift can travel downwards into the magazine while compressing the spring, and prior to encountering an abutment that prevents further movement of the lift. The abutment is generally constituted by a projection carried by the walls of the magazine or is merely constituted by the spring reaching maximum compression.

Also, patent BE A 670 534 (FABRIQUE NATIONALE D'ARMES DE GUERRE) discloses a firearm that includes a pivotally mounted magazine. The inside wall of the breech casing of the firearm posses a loading orifice in front of the trigger through which orifice cartridges are fed in succession from a removable magazine. The magazine is carried by a support element that is tiltably mounted relative to the breech casing and that is held by a manually-actuatable retaining element. The magazine support is hinged relative to the firearm about a pivot situated beneath the handguard, in front of the magazine well, and fitted with a spring.

SUMMARY OF THE INVENTION

The problem posed consists in providing a firearm fitted with a non-removable pivoting magazine that can contain no more than some predetermined number of cartridges (e.g. two). A problem that is posed also consists in providing a firearm whose pivoting magazine cannot be replaced by another magazine.

A problem posed also consists in providing a device that makes it possible to ensure that the pivoting magazines are not removable.

The solution to the problem posed consists in providing an individual firearm having a magazine-forming case that is pivotally mounted about a transverse axis XX (which is substantially horizontal when the firearm is in its position of use, and perpendicular to the longitudinal axis YY of the firearm barrel) on a pin extending along said transverse axis XX and forming a pivot; the firearm includes a breech casing having a magazine well whose general shape is substantially parallelepipedal (or tubular of rectangular section with rounded corners) extending along a longitudinal axis ZZ (i.e. extending along the stacking direction for cartridges in the magazine proper) substantially perpendicular to said transverse axis XX (and to said longitudinal axis YY of the barrel), which magazine well is provided with an opening at its bottom end, which magazine case includes a top portion forming a magazine proper that is substantially parallelepipedal (or tubular) in shape, and in which cartridges can be stacked; the magazine case includes, in its bottom portion, a spring urging a plate that constitutes a cartridge lift (or platform) outwards (or upwards) from said magazine; said pin extends crosswise into said magazine well and is mounted via at least one of its two ends in a respective recess provided in the left or right side walls of said magazine well; said pin extends inside said magazine case, through at least one of the left or right side walls of said magazine in which an orifice is provided; said pin is situated in the immediate vicinity of a bottom abutment limiting the stroke of said cartridge lift, i.e. situated at a short distance from said abutment as measured along the longitudinal axis ZZ in which cartridges are stacked.

In the present patent application, the terms "front" (or "anterior"), "rear" (or "posterior"), "left", "right", "up", "down", "horizontal", and "vertical" are generally referred to a user of the firearm and holding it in the firing position, except where the technical context clearly specifies that some other meaning is to be given thereto, where appropriate.

In preferred embodiments:

said pin extends inside said magazine well, passes through it, and is mounted at each of its two ends in respective recesses provided in the left and right side walls of said magazine well of said breech casing; said pin extends inside said magazine case, passes right through it, and extends beyond the left and right side walls of said magazine, in which two orifices are provided in alignment;

said pin forms or constitutes a bottom abutment limiting the stroke of said cartridge lift towards the bottom of said magazine;

said pin is rigidly fixed in the side walls of said breech casing, and said magazine is mounted to pivot freely about said pin by means of said openings or orifices provided in its side walls, with the smallest dimension (or section) thereof being greater than the largest dimension (or section) of said pin;

said pin is mounted in the vicinity of one of other of the front and rear (anterior and posterior) walls of said breech casing;

the distance between said transverse axis XX and the inside face of the nearer of said front and rear walls of said magazine well is less than one-fourth of the length of said magazine well;

said openings provided in said left and right side walls of said magazine are oblong slots and said pin is of substantially circular profile (or section);

said pin includes a zone of weakness constituting a breakage initiator favoring breakage of said pin in said zone of weakness in the event of a strong force being exerted on said magazine to pull it out or in the event of any attempt at extracting or breaking the pin;

one of the recesses is constituted by a tapped hole passing through one of the side walls (e.g. right) of said magazine well and another recess is constituted by a blind hole formed in the inside portion of the other side wall (e.g. left) of said magazine well, and said pin includes a threaded portion at one of its two ends suitable for being screwed into said tapped hole and then glued;

a first cutback A (or setback) is provided in the front bottom portion of said magazine, and a second cutback (e.g. of circular outline) B is provided in the rear top corner of said magazine, and said pin on the axis XX is situated in the vicinity of the front wall of said magazine well; and said pin is constituted by two portions (or half-pins) each passing through a respective one of the left and right side walls of said magazine and respectively fixed rigidly in the left and right side walls of said magazine well.

The invention makes it possible to provide a firearm that is fitted with a non-removable pivoting magazine that is incapable of containing more cartridges than some determined number thereof. The invention also provides a firearm which is such that in the loading position, i.e. when the pivoting magazine is open so as to enable cartridges to be inserted into the magazine, the magazine partially obstructs the opening situated in the bottom portion of the magazine well and consequently prevents any other magazine being inserted into the magazine well. In a preferred embodiment of the invention, it is made impossible to separate the magazine from the firearm without exerting a very large pullout force which has the effect of breaking the pin, such that a portion thereof remains fixed inside the magazine well.

In this embodiment of the invention, because of the existence of a zone of weakness provided near the central portion of the pin, should the magazine ever be pulled out of the firearm, then a projecting portion of the pin remains behind in the magazine well, thereby also preventing another magazine being inserted.

The invention also provides a firearm in which the magazine is prevented from being removed while nevertheless facilitating cartridge insertion (or cartridge extraction).

The device of the invention makes it possible to hinge a magazine case of a semi-automatic firearm to the magazine well, while making the magazine case inseparable or non-removable from the firearm to which it is mounted.

The device of the invention makes it possible to cause the magazine of an existing firearm that is already fitted with a sliding or a pivoting magazine to be made pivoting and non-removable without requiring major and expensive machining.

The position of the pivot axis of the magazine case relative to the magazine well is either through the central or top portion of the magazine well, or else through its bottom portion, e.g. by providing an extension of the left and right side walls of the magazine well; the pivot pin is preferably situated opposite the latch or lock of the magazine (near the front of the magazine well if the latch is situated near the back thereof, and vice versa).

For a magazine that engages relatively shallowly into the magazine well, the position of the pivot axis can be directly inside the central portion of the magazine well, and openings provided in the side walls of the magazine enable it to move in very limited linear translation (i.e. the magazine moves relative to the pin, when the openings are oblong or elongate in shape) or else not at all (when the openings provided in the walls of the magazine are circular in shape).

The outside shape or profile of the magazine enables it to pivot about said pin without coming into abutment against the front or rear walls of the magazine well, while still remaining compatible with the function of holding and presenting cartridges which, when the magazine is in its closed position, requires the walls thereof to be in the immediate vicinity of the walls of the magazine well.

For a magazine that engages relatively deeply into the magazine well, it is necessary to provide pivoting movement in association with linear translation movement of the magazine case that enables the magazine case to be moved far enough down towards the bottom of the magazine well to enable it subsequently to pivot about a pivot pin provided in the magazine well; under such circumstances, the openings or orifices provided in the magazine walls are elongate in shape.

BRIEF DESCRIPTION OF THE DRAWINGS

The numerous advantages provided by the invention will be better understood on reading the following description which refers to the accompanying drawings that show, in entirely non-limiting manner, preferred embodiments of firearms of the invention.

FIG. 1 is a diagrammatic exploded perspective view showing the three main parts of a firearm of the invention, namely the breech casing, the magazine, and its pivot pin.

FIG. 2 is a side view, partially in section, showing a firearm fitted with a magazine of the invention, the magazine being shown in its operating position.

FIG. 3 is a side view, partially in section, showing the same apparatus as FIG. 2, but with the magazine being shown in FIG. 3 in an open position and supplied with two cartridges.

FIGS. 6 and 7 are fragmentary section views in a vertical plane showing a firearm fitted with a device of the invention; in the position shown in FIG. 6, the magazine is engaged in the magazine well and it shown in its operating position (even though the magazine is not supplied with cartridges); in the position shown in FIG. 7, the same magazine is illustrated in its position enabling it to be loaded with cartridges.

DETAILED DESCRIPTION OF PREFERRED EMBODIMENTS

Figure 4:
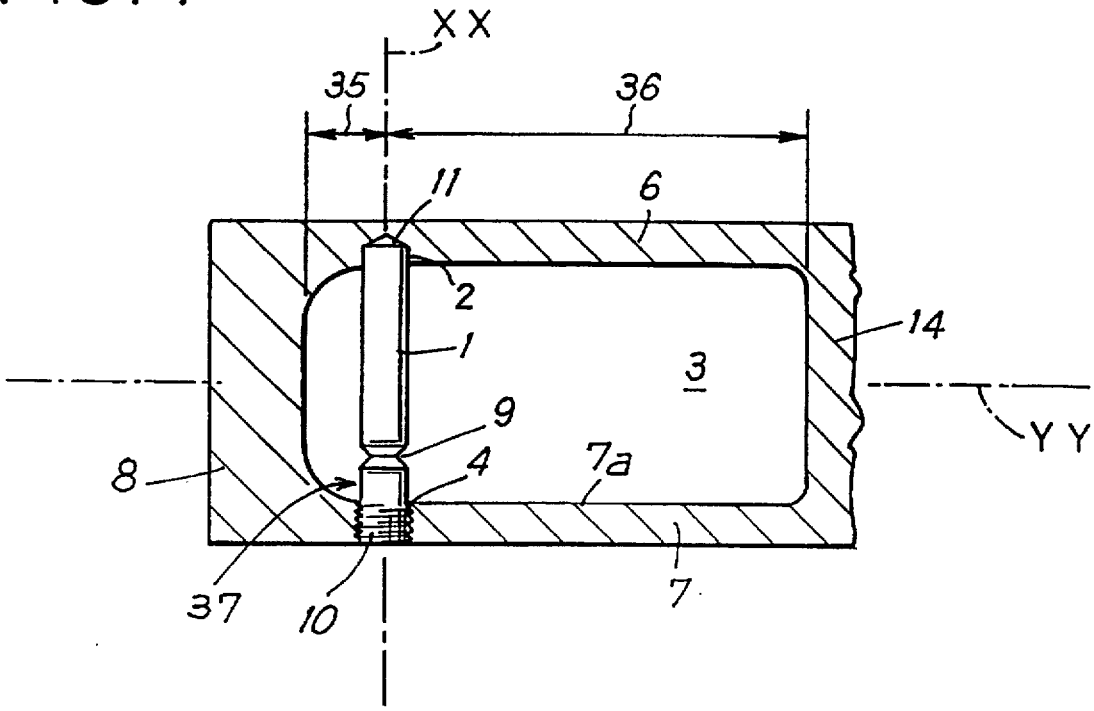
FIGS. 4 and 5 are diagrammatic views in a horizontal plane showing the characteristics of a magazine well and of a magazine in a firearm of the invention; these two figures are simplified views on V—V in FIG. 6, the magazine being omitted from FIG. 4 in order to improve the clarity of this figure.
Figure 5:
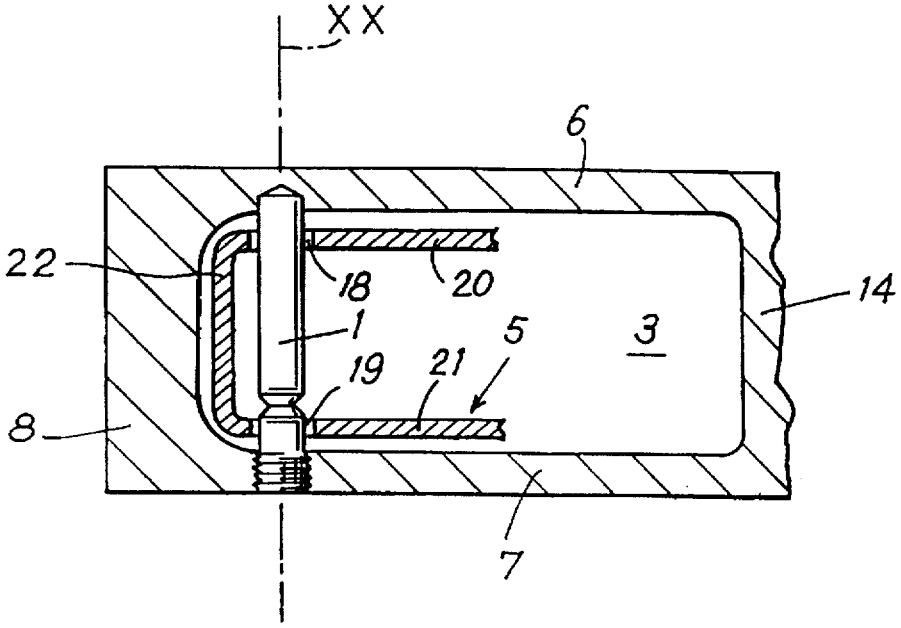

With reference to FIGS. 1 to 3, the device incorporated in firearms of the invention comprises a pin 1 whose ends are fixed in recesses 2, 4 provided in the side walls 6, 7 of the magazine well 3 in the breech casing 38. The pin 1 passes through recesses (or orifices) 18, 19 provided in the side walls 20, 21 of the magazine, as also shown in FIGS. 4 and 5.

Figure 6:
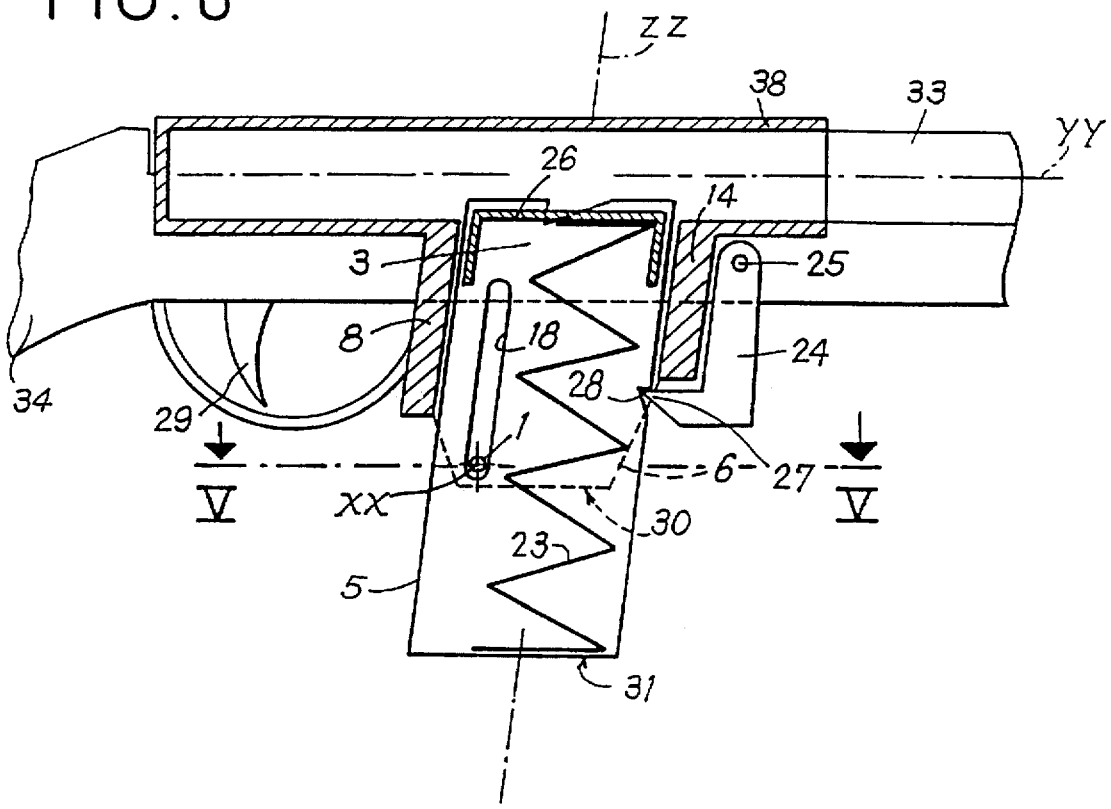
FIGS. 6 and 7 correspond to a second embodiment of a firearm of the invention in a situation where the magazine engages relatively deeply into the magazine well (in contrast to the situation shown in FIGS. 1 to 3 and 8).
Figure 7:
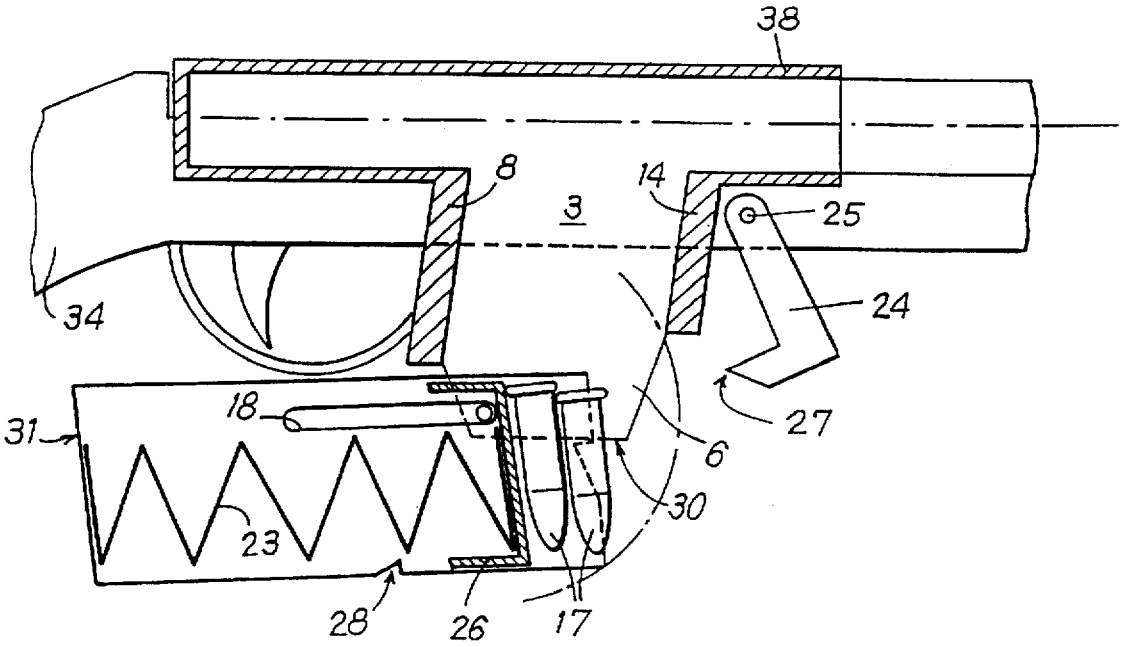

As shown in FIGS. 1 to 5, the magazine case 5 is generally parallelepipedal or tubular in shape about an axis ZZ that is substantially vertical when the firearm is in its position of use, as shown in FIGS. 6 and 7, i.e. when the longitudinal axis YY of the barrel 33 is horizontal.

As shown in FIGS. 1 to 3, the magazine whose general shape is substantially parallelepipedal is provided both with a cutback or setback A in its anterior or front bottom portion, enabling the magazine to be pivoted through an angle of about 60° to 90° in the direction of arrow 42, and with a setback B provided in its top rear portion.

It can be seen in FIG. 3 that these two setbacks make it possible to open the magazine by pivoting it about the axis XX along which the pivot pin 1 extends.

The breech casing 38 shown in FIG. 1 is designed to co-operate at its front end 38 B with the rear end of the firearm barrel, as shown in FIGS. 6 and 7, and at its rear end 38 A with a butt 34 as shown in FIGS. 2, 3, 6, and 7.

As shown in FIG. 1, it can be seen that once the magazine is mounted on the pivot pin 1 which is engaged in the openings or recesses 2 and 4 in the side walls of the magazine well 3 in the breech casing 38, it is contained or received between the front, rear, and side walls 14, 8, 6, and 7 of the magazine well, as can also be seen in FIGS. 2 and 3.

In the embodiment shown in FIGS. 2 and 3, the pivot axis XX of the pin 1 is situated close to the anterior or front wall 14 of the magazine well, with the posterior or rear wall 8 of the magazine well being fitted with a bolt or latch 39 pivotally mounted about an axis $XX_1$ that is parallel to the axis XX, i.e. a transverse axis. Latch 39 includes a projection 40 at its top end (see FIG. 8) suitable for acting as a tip for engaging in a cavity 41 (see FIG. 8) provided in the rear wall (see FIG. 8) of the magazine case, when the case is in its operating position engaged inside the magazine well.

It can also be seen in FIG. 3 that in a preferred embodiment the magazine case 5 also includes a projecting portion 43 on its front face suitable for co-operating with a cavity 44 provided in the front wall of the magazine well 3 so as to constitute a safety catch serving to hold the magazine in place.

It will be understood that pivoting movement of the magazine case 5 relative to the magazine well 3 in a firearm of the invention facilitates disengagement of the safety catch 43 from said cavity 44.

In the embodiment shown in FIG. 3, it can be seen that the magazine case includes a platform 26 that forms a loading abutment or support when the cartridges 17 are inserted into the magazine through the top portion thereof. The platform is urged towards the top of the magazine, i.e. to the left in FIG. 3, by a spring 23 that has one of its ends bearing against the bottom 31 of the magazine case and that has its other end bearing against the bottom face of the platform 26, thereby tending to urge it to the left (with reference to FIG. 3).

It can also be seen in this figure that the pivot pin 1 extending along the axis XX serves as an abutment for said cartridge-supporting platform.

With reference to FIG. 3, it can be seen that the cutback B provided in the rear top portion of the magazine 5 preferably follows a radius R centered on the axis XX so as to allow the magazine to pivot in the direction of arrows 42.

With reference to FIGS. 6 and 7, showing another embodiment of the invention, the magazine 5 is elongate in shape along an axis ZZ that is substantially perpendicular to the longitudinal axis YY of the barrel and to the transverse axis XX along which the pivot pin 1 extends.

In known manner, the bottom portion of the breech casing 38 includes a cavity 3 defined by front and rear walls 14 and 8, constituting the magazine well which is substantially parallelepipedal in shape, so as to enable the magazine 5 to slide inside the magazine well 3.

In this embodiment, the side walls 6 and 7 of the magazine well are extended downwards and, in the vicinity of their bottom edges or ends 30 they carry recesses for receiving the ends of the pivot pin 1.

The magazine 5, including its platform 26 urged by the spring 23 in the manner described above, has oblong openings (or slots) 18 in its side walls enabling the magazine to slide inside the magazine well along the axis ZZ, i.e. enabling it to perform a linear translation movement subsequently followed by the magazine rotating about the pivot axis XX as shown in FIG. 7 so as to allow the magazine to be loaded with cartridges 17, or to be unloaded.

This figure also shows a latch 24 situated in front of the front wall 14 of the magazine well and capable of co-operating with a cavity 28 provided in the front face of the magazine case 5.

Figure 8:
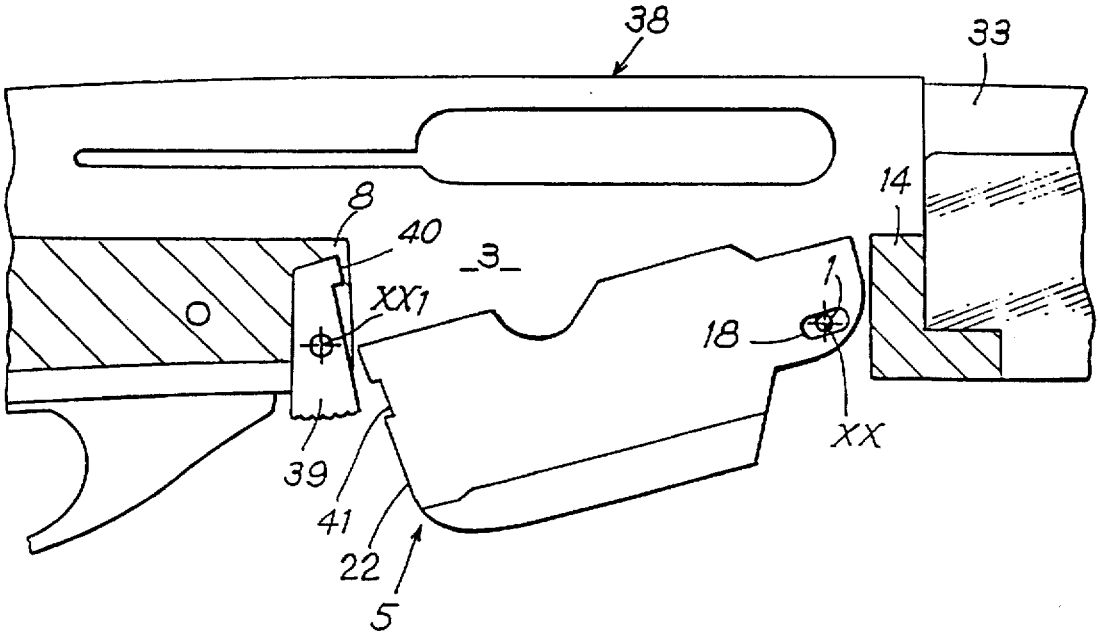
FIG. 8 shows a variant of the embodiment shown in FIGS. 1 to 3, in which the magazine is fitted with openings for receiving the pivot pin that are oblong or elongate in shape.

The latch 24 pivoting about the axis 25 shown in FIG. 7 performs the same functions as the latch 39 of FIGS. 2, 3, and 8, and it is disposed in a position that is upside-down relative to those figures. As shown in FIGS. 6 and 7, the pivot pin 1 extends along the axis XX which is situated close to the rear wall 8 of the magazine well, i.e. at the end opposite to the latch 24, as is likewise the case in FIGS. 2 and 3.

As shown in FIGS. 4 and 5, the pivot pin 1 extends along the transverse axis XX perpendicular to the axis YY which is the longitudinal axis of the firearm and/or of the firearm barrel, and, as shown in FIG. 5, it passes through the side walls 20 and 21 of the magazine 5 which can be engaged in the magazine well 3 as defined by a front wall 14, side walls 6 and 7, and a rear wall 8.

In the embodiment shown in these figures, the pin 1 is provided with a zone of weakness 9 which is situated close to a threaded end 10 of the pin 1 suitable for being screwed into a recess 4 constituted by a tapped hole provided in the side wall 7 of the magazine well.

The other end 11 of said pin 1 is received in a blind hole 2 provided in the side wall 6 of the magazine well, the pin passing through orifices 18 and 19 provided in the side walls of the magazine 5.

It can also be seen in FIG. 4 that because of the zone of weakness 9 which constitutes a point for initiating breakage of the pin 1 in the event of excess traction being applied to the magazine, causing the magazine to be pulled out from the magazine well and breaking the pin 1, the break takes place preferentially in said zone 9, leaving behind a portion 37 of the pin (situated between said zone of weakness 9 and the end 10 that is screwed into the side wall 7), which portion 37 then serves to prevent another magazine being inserted, said portion 37 continuing to project from the inside face 7 A of the wall 7.

It can also be seen in this figure that the distance along an axis parallel to the longitudinal axis YY of the firearm between the inside face of the rear wall 8 and the axis XX along which the pin 1 extends, which distance is referenced 35 in the figure, is preferably less than one-fourth of the total length of the magazine well as measured along the axis YY, i.e. the sum of the lengths or distances referenced 35 and 36 in this figure.

In the embodiment shown in FIG. 8, the magazine 5 is fitted with openings 18 through which the pivot pin 1 extends, which openings are elongate in a longitudinal direction, i.e. a direction parallel to the axis along which the firearm barrel extends when the magazine is in the operating position, as shown in FIG. 2, in particular, thereby making it easier to open the magazine and enabling it to move relative to the magazine well with a combination of rotation plus translation through a short distance.

In the embodiment shown in FIG. 8 which corresponds to magazine movement that includes both pivoting and displacement in linear translation, by having oblong recesses for the pin in the side walls of the magazine, there is no need to provide a cutback in the outside shape of the magazine, e.g. the cutback in the top rear corner thereof. It may still be necessary to have a cutback in the bottom front corner as shown in this figure. In this embodiment, the magazine moves in translation while pivoting (downwards or upwards) and it automatically centers itself in the magazine well. Naturally, it is necessary that the sum of the distances between the axis and the point of contact of the magazine against the rear wall of the magazine well and between the axis and the point of contact of the magazine against the front wall of the magazine well should not exceed the length of the magazine well.

The pin 1 may be solid pin, or a hollow pin, or a resilient pin, and it may be smooth or it may have a thread. The pin may be of sufficient length to interconnect the two walls of the magazine well 3 in the breech casing by passing through the magazine 5.

The pin 1 may be made up of two half-pins hinging the right and left walls of the magazine respectively to the corresponding walls of the magazine well 3, or it may be constituted by a single half-pin on one side or the other.

The pin 1 may be rigidly fixed to the side walls 20 and 21 of the magazine 5, in which case it is the pin 1 that pivots freely in the recesses 2 and 4 provided in the magazine well 3. Alternatively, the pin 1 may be fixed to the magazine well 3, in which case it is the magazine 5 that pivots on the pin 1.

The recesses 18 and 19 in the magazine 5 for receiving the pin 1 may be constituted merely by holes drilled through the walls of the magazine 5 (when only pivoting is performed). The recesses 18, 19 in the magazine 5 for receiving the pin 1 may be implemented in the form of an oblong orifice, an elongate notch, or a groove, or a corrugation stamped in the wall of the magazine 5 (when pivoting is associated with movement in linear translation).

The recesses 2 and 4 for receiving the pin 1 may also be provided in the form of grooves formed in the inside faces of the side walls of the magazine well 3. Under such circumstances, the magazine 5 carries a pin 1 which both slides and pivots in said grooves (when pivoting is associated with movement in linear translation).

Either the magazine 5 can be modified so as to solve the geometrical problem posed by pivoting, or else it can be originally manufactured with the appropriate shape.

The shape required by the magazine 5 to enable it to pivot is determined by the position of the pin 1 relative to the bottom edge and to the rear edge of the magazine 5, the distances between the pin 1 and said edges being less than or equal to the distance between the pin 1 and the front wall of the magazine well 3. After limited pivoting and preventing the insertion of another magazine, displacement of the magazine 5 puts it into contact with the front wall of the magazine well 3, thereby limiting displacement thereof. This special shape for the magazine 5 is given reference A in the drawings.

The special shape for the magazine 5 given reference B in the drawings is determined by the position of the pin 1 relative to the rear edge of the magazine 5 so that the distance between said rear edge and the pin 1 is less than or equal to the distance between the pin 1 and the rear wall of the magazine well 3.

What is claimed is:

1. An individual firearm comprising a magazine case pivotally mounted on a pin about a transverse axis XX, which firearm includes a breech casing having a magazine well whose general shape is substantially parallelepipedal and which is provided with an opening at its bottom end, which magazine case includes a magazine-forming top portion and includes, in its bottom portion, a spring acting against a cartridge lift, wherein said pin extends crosswise into said magazine well and is mounted via at least one of its two ends in a respective recess provided in the left or right side walls of said magazine well, and wherein said pin extends inside said magazine case, through at least one of the left or right side walls of said magazine in which an orifice is provided, the arrangement of said pin in said magazine well and in said magazine securing said magazine in said well and preventing separation of said magazine from said breech casing.

2. A firearm according to claim 1, in which said pin passes through said magazine well and is mounted via each of its two ends in respective recesses provided in the left and right side walls of said magazine well, passes through the left and right side walls of said magazine in which two aligned orifices are provided, and constitutes a bottom abutment limiting the stroke of said cartridge lift.

3. A firearm according to claim 1, in which said pin is rigidly fixed in the side walls of said magazine well in said breech casing, and said magazine is mounted to pivot freely on said pin.

4. A firearm according to claim 1, in which said pin is mounted in the vicinity of one or other of the front or rear walls of said magazine well in said breech casing.

5. A firearm according to claim 4, in which a distance between said transverse axis XX and an inside face of the closer end wall of said magazine well is less than one-fourth of the length of said magazine well.

6. A firearm according to claim 2, in which said orifices are oblong slots.

7. A firearm according to claim 1, in which said pin includes a zone of weakness constituting an initiator for breakage.

8. A firearm according to claim 2, in which a first one of said recesses is constituted by a tapped hole passing through a first one of said side walls of said magazine well, and in which a second one of said recesses is constituted by a blind hole formed in the inside portion of a second one of said side walls of said magazine well, and in which said pin has a threaded portion at one of its two ends.

9. A firearm according to claim 1, in which a cutback is provided in the front bottom portion of said magazine.

10. A firearm according to claim 1, in which a cutback is provided in a rear top corner of said magazine, and in which said pin is situated in the vicinity of the front wall of said magazine well.

11. A firearm according to claim 1, in which said pin is constituted by two half-pins each passing through a respective one of said left or right side walls of said magazine and rigidly fixed respectively in the left or right side wall of said magazine well.

12. A firearm according to claim 1, in which said pin is rigidly fixed in the side walls of said magazine and is mounted to pivot freely in openings provided in the side walls of said magazine well.

13. An individual firearm comprising a magazine case pivotally mounted on a pin about a transverse axis XX, which firearm includes a breech casing having a magazine well whose general shape is substantially parallelepipedal and which is provided with an opening at its bottom end, which magazine case includes a magazine-forming top portion end includes, in its bottom portion, a spring acting against a cartridge lift, wherein said pin extends crosswise into said magazine well and is mounted by its two ends in respective recesses provided in the left and right side walls of said magazine well, and wherein said pin extends inside said magazine case, through two aligned orifices in the left and right side walls of said magazine provided.

14. A firearm according to claim 13, in which said pin constitutes a bottom abutment limiting the stroke of said cartridge lift.

15. A firearm according to claim 13, in which said pin is rigidly fixed in the side walls of said magazine well in said breech casing, and said magazine is mounted to pivot freely on said pin.

16. A firearm according to claim 13, in which said pin is mounted in the vicinity of one or other of the front or rear walls of said magazine well in said breech casing.

17. A firearm according to claim 16, in which a distance between said transverse axis XX and an inside face of the closer end wall of said magazine well is less than one-fourth of the length of said magazine well.

18. A firearm according to claim 13, in which said orifices are oblong slots.

19. A firearm according to claim 13, in which said pin includes a zone of weakness constituting an initiator for breakage.

20. A firearm according to claim 13, in which a first one of said recesses is constituted by a tapped hole passing through a first one of said side walls of said magazine well, and in which a second one of said recesses is constituted by a blind hole formed in the inside portion of a second one of said side walls of said magazine wall, and in which said pin has a threaded portion at one of its two ends.

21. A firearm according to claim 13, in which a cutback is provided in the front bottom portion of said magazine.

22. A firearm according to claim 13, in which a cutback is provided in the rear top corner of said magazine, and in which said pin is situated in the vicinity of the front wall of said magazine well.

23. A firearm according to claim 13, in which said pin is constituted by two half-pins each passing through a respective one of said left or right side walls of said magazine and rigidly fixed respectively in the left or right side wall of said magazine well.

24. A firearm according to claim 13, in which said pin is rigidly fixed in the side walls of said magazine and is mounted to pivot freely in openings provided in the side walls of said magazine well.

* * * * *